US005286172A

United States Patent [19]

Taguchi

[11] Patent Number: 5,286,172

[45] Date of Patent: Feb. 15, 1994

[54] SLANT PLATE TYPE COMPRESSOR WITH VARIABLE CAPACITY CONTROL MECHANISM

[75] Inventor: Yukihiko Taguchi, Maebashi, Japan

[73] Assignee: Sanden Corporation, Gunma, Japan

[21] Appl. No.: 996,773

[22] Filed: Dec. 23, 1992

[30] Foreign Application Priority Data

Dec. 26, 1991 [JP] Japan ..... 3-345311

[51] Int. Cl.[5] ..... F04B 1/26

[52] U.S. Cl. ..... 417/222.2; 417/270

[58] Field of Search ..... 417/222.1, 222.2, 270

[56] References Cited

U.S. PATENT DOCUMENTS

| | | | |
|---|---|---|---|
| 4,231,713 | 11/1980 | Widdowson et al. | 417/222 |
| 4,526,516 | 7/1985 | Swain et al. | 417/222.2 |
| 4,533,299 | 8/1985 | Swain et al. | 417/222.2 |
| 4,606,705 | 8/1986 | Parekh | 417/222 |
| 4,688,997 | 8/1987 | Suzuki et al. | 417/222 |
| 4,730,986 | 3/1988 | Kayukawa et al. | 417/222 |
| 4,747,753 | 5/1988 | Taguchi | 417/222 |
| 4,780,059 | 10/1988 | Taguchi | 417/222 |
| 4,842,488 | 6/1989 | Terauchi | 417/222 |
| 4,913,626 | 4/1990 | Terauchi | 417/222 |
| 4,940,393 | 7/1990 | Taguchi | 417/222.2 |
| 5,051,067 | 9/1991 | Terauchi | 417/222 R |
| 5,071,321 | 12/1991 | Skinner et al. | 417/222.2 |
| 5,080,561 | 1/1992 | Taguchi | 417/222.2 |
| 5,092,741 | 3/1992 | Taguchi | 417/222.2 |
| 5,094,589 | 3/1992 | Terauchi et al. | 417/222 S |
| 5,145,326 | 9/1992 | Kimura et al. | 417/222.2 |
| 5,165,863 | 11/1992 | Taguchi | 417/222.2 |

FOREIGN PATENT DOCUMENTS

| | | |
|---|---|---|
| 61-55380 | 3/1986 | Japan . |
| 2153922 | 1/1985 | United Kingdom . |

*Primary Examiner*—Richard A. Bertsch
*Assistant Examiner*—Peter Korytnyk
*Attorney, Agent, or Firm*—Baker & Botts

[57] ABSTRACT

A slant plate type compressor having a capacity or displacement adjusting mechanism includes a housing for a cylinder block provided with a plurality of cylinders and a crank chamber. A piston is slidably fitted within each of the cylinders and is reciprocated by a drive mechanism which includes a slant plate having a surface with an adjustable incline angle. The incline angle of the slant plate, and thus the capacity of the compressor, is controlled according to the pressure differential between the crank chamber and the suction chamber. The pressure in the suction chamber is controlled by a valve control mechanism which is disposed in a passageway linking the crank chamber and the suction chamber. An internally controlled safety valve device prevents an abnormal pressure differential between the crank and suction chambers. The internally controlled safety valve device is provided within the valve control mechanism, thereby obtaining an easily manufactured slant plate type compressor having a durable and reliable capacity adjusting mechanism with a safety valve device.

13 Claims, 5 Drawing Sheets

SLANT PLATE TYPE COMPRESSOR WITH VARIABLE CAPACITY CONTROL MECHANISM

BACKGROUND OF THE INVENTION

1. Technical Field

The present invention generally relates to a refrigerant compressor, and more particularly, to a slant plate type compressor, such as a wobble plate type compressor, with a variable displacement mechanism which is suitable for use in an automotive air conditioning system.

2. Description of The Prior Art

Slant plant type piston compressors including variable displacement or capacity adjusting mechanisms for controlling the compression ratio of a compressor in response to demand are generally known in the art. For example, Japanese Utility Model Application Publication No. 63-134181 discloses a wobble plate type compressor including a cam rotor driving device and a wobble plate linked to a plurality of pistons. Rotation of the cam rotor driving device causes the wobble plate to nutate and thereby successively reciprocate the pistons in the corresponding cylinders. The stroke length of the pistons and thus the capacity of the compressor may be easily changed by adjusting the slant angle of the wobble plate. The slant angle is changed in response to the pressure differential between the crank chamber and the suction chamber.

In the above-mentioned Japanese Utility Model Application Publication, the crank chamber and the suction chamber are linked in fluid communication by a first path or passageway. A valve mechanism is disposed in the first passageway in order to control fluid communication between the crank and suction chambers by the opening and closing of the first passageway. The valve mechanism generally includes a pressure sensing device for sensing pressure in the suction chamber, a solenoid, a plunger and a valve member fixedly connected to both the pressure sensing device and one end of the plunger. The solenoid receives two external signals, one of which represents the heat load on an evaporator of a cooling circuit and another of which represents the amount of demand for accelerating an automobile.

The valve member opens and closes the first passageway in response to changes in the suction chamber pressure so as to change the crank chamber pressure relative to the suction chamber pressure. This then results in a change in the angular position of the wobble plate so that the capacity displacement of the compressor is adjusted and a control point of the suction chamber pressure is maintained at a predetermined constant value.

The solenoid induces various electromagnetic attraction forces responsive to changes in the two external signals to thereby change the axial position of the plunger. This then changes the control point of the suction chamber pressure from predetermined maximum to predetermined minimum values.

The compressor further includes a second passageway, separate from the first passageway, which communicates between the crank chamber and the suction chamber. A safety valve device, including a ball member and a coil spring elastically supporting the ball member, is disposed in the second passageway. The safety valve device opens and closes the second passageway in response to changes in the pressure differential between the crank chamber and the suction chamber. The second passageway is opened when the pressure differential between the crank chamber and the suction chamber exceeds a predetermined value. Therefore, when communication between the crank chamber and the suction chamber is blocked for a long time period due to trouble in the valve mechanism, thereby causing an abnormal rise in the crank chamber pressure because of blow-by gas leaking past the pistons in the cylinders as the pistons reciprocate, the second passageway is opened to forcibly and quickly reduce the crank chamber pressure and thereby prevent an abnormal pressure differential between the crank and suction chambers. As a result, excessive friction between internal component parts of the compressor caused by abnormal pressure differential between the crank chamber and the suction chamber can be prevented.

In this prior art embodiment, however, since the second passageway is separate from the first passageway, the process of forming the second passageway and the process of disposing the safety valve device in the second passageway are additional steps required during the manufacturing of the compressor. Accordingly, the manufacturing process for the compressor is complicated. Therefore, it is highly desirable to provide a compressor having a variable displacement control mechanism which can be easily manufactured and which can prevent an abnormal pressure differential between the crank and suction chambers.

SUMMARY OF THE INVENTION

A slant plate type refrigerant compressor including a compressor housing enclosing a crank chamber, a suction chamber and a discharge chamber therein is disclosed. The compressor housing includes a cylinder block having a plurality of cylinders formed therethrough, and a piston slidably fitted within each of the cylinders. A drive mechanism is coupled to the pistons for reciprocating the pistons within the cylinders. The drive mechanism includes a drive shaft rotatably supported in the housing and a coupling mechanism which drivingly couples the drive shaft to the pistons such that the rotating motion of the drive shaft is converted into reciprocating motion of the pistons. The coupling mechanism includes a slant plate having a surface disposed at an adjustable inclined angle relative to a plane perpendicular to the drive shaft. The inclined angle of the slant plate is adjustable in response to changes in the crank chamber pressure relative to the suction chamber pressure to vary the stroke length of the pistons in the cylinders to thereby vary the capacity of the compressor. A passageway is formed in the housing and links the crank and suction chambers in fluid communication.

A capacity control mechanism varies the capacity of the compressor by adjusting the inclined angle of the slant plate. The passageway includes a valve seat formed therein. The capacity control mechanism includes a valve control device for controlling the opening and closing of the passageway in response to changes in the suction chamber pressure to thereby control the capacity of the compressor. The valve control device is disposed in the passageway, and includes a pressure detector for detecting the suction chamber pressure and a valve element which is connected to the pressure detector. The valve element is received on and moves away from the valve seat in response to changes in the suction chamber pressure so as to open and close the passageway to thereby control the capacity of the compressor.

The valve element includes a valve member, a rod member fitly disposed through the valve member, and a biasing element for biasing the valve member into engagement with the rod member to a first position along the rod member as long as the valve member is away from the valve seat. The valve member is forcibly disengaged from the first position along the rod member by slidably moving along the rod member to a second position so as to be away from the valve seat in order to open the passageway when the pressure differential between the crank chamber and the suction chamber exceeds a predetermined value.

DETAILED DESCRIPTION OF THE PREFERRED EMBODIMENT

Figure 1:
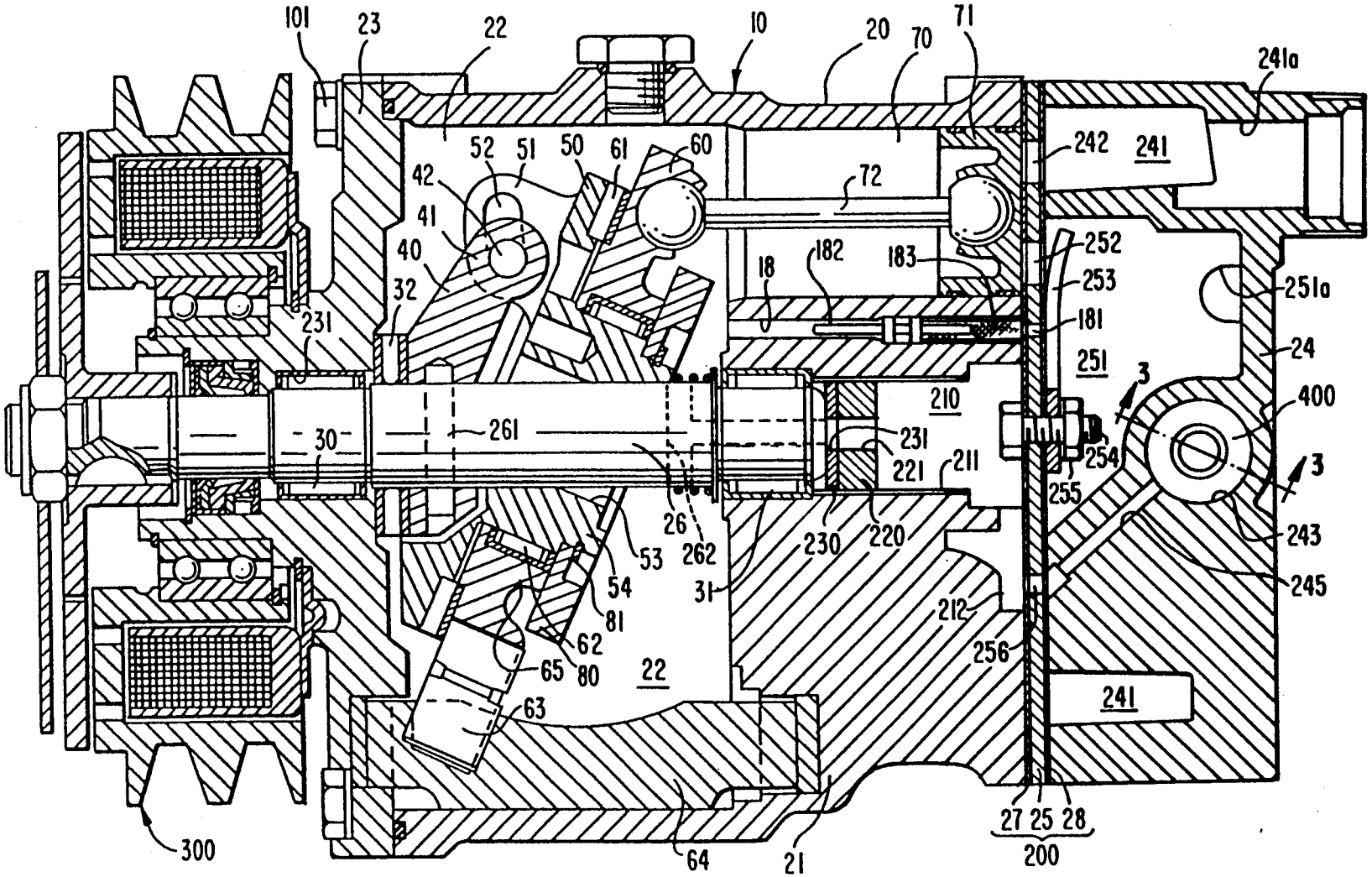
FIG. 1 illustrates a vertical longitudinal sectional view of a slant plate type refrigerant compressor including a capacity control mechanism according to one embodiment of this invention.

In FIG. 1, for purposes of explanation only, the left side of the figure will be referenced as the forward end or front of the compressor, and the right side of the figure will be referenced as the rearward end or rear of the compressor.

With reference to FIG. 1, the overall construction of a slant plate type compressor, and more specifically wobble plate type refrigerant compressor 10 having a capacity control mechanism in accordance with one embodiment of the present invention, is shown. Compressor 10 includes cylindrical housing assembly 20 including cylinder block 21, front end plate 23 disposed at one end of cylinder block 21, crank chamber 22 enclosed within cylinder block 21 by front end plate 23, and rear and end plate 24 attached to the other end of cylinder block 21. Front end plate 23 is mounted on cylinder block 21 forward of crank chamber 22 by a plurality of bolts 101. Rear end plate 24 is also mounted on cylinder block 21 at the opposite end by a plurality of bolts (not shown). Valve plate 25 is located between rear end plate 24 and cylinder block 21. Opening 231 is centrally formed in front end plate 23 for rotatably supporting drive shaft 26 by bearing 30 disposed therein. The inner end portion of drive shaft 26 is rotatably supported by bearing 31 disposed within central bore 210 of cylinder block 21. Bore 210 extends to a rear end surface of cylinder block 21.

Bore 210 includes thread portion 211 formed at an inner peripheral surface of a central region thereof. Adjusting screw 220 having a hexagonal central hole 221 is screwed into thread portion 211 of bore 210. Circular disc-shaped spacer 230 having central hole 231 is disposed between the inner end surface of drive shaft 26 and adjusting screw 220. Axial movement of adjusting screw 220 is transferred to drive shaft 26 through spacer 230 so that these elements move axially within bore 210. The above mentioned construction and functional manner are described in detail in U.S. Pat. No. 4,948,343 to Shimizu.

Cam rotor 40 is fixed on drive shaft 26 by pin member 261 and rotates with drive shaft 26. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is disposed adjacent cam rotor 40 and includes opening 53. Drive shaft 26 is disposed through opening 53. Slant plate 50 includes arm 51 having slot 52. Cam rotor 40 and slant plate 50 are connected by pin member 42, which is inserted in slot 52 to create a hinged joint. Pin member 42 is slidable within slot 52 to allow adjustment of the angular position of slant plate 50 with respect to a plane perpendicular to the longitudinal axis of drive shaft 26. A balance weight ring 80 having a substantial mass is disposed on a nose of hub 54 of slant plate 50 in order to balance the slant plate 50 under dynamic operating conditions. Balance weight ring 80 is held in place by means of retaining ring 81.

Wobble place 60 is nutatably mounted on hub 54 of the slant plate 50 through bearings 61 and 62 which allow slant plate 50 to rotate with respect to wobble plate 60. Fork-shaped slider 63 is attached to the radially outer peripheral end of wobble plate 60 and is slidably nutated about sliding rail 64 disposed between front end plate 23 and cylinder block 21. Fork-shaped slider 63 prevents the rotation of wobble plate 60 so that wobble plate 60 nutates along rail 64 when cam rotor 40, slant plate 50 and balance weight ring 80 rotate. Undesirable axial movement of wobble plate 60 on hub 54 of slant plate 50 is prevented by contact between a rear end surface of inner annular projection 65 of wobble plate 60 and a front end surface of balance weight ring 80. Cylinder block 21 includes a plurality of peripherally located cylinder chambers 70 in which pistons 71 are fitly slidably disposed. Each piston 71 is connected to wobble plate 60 by a corresponding connecting rod 72. Accordingly, nutation of wobble plate 60 thereby causes pistons 71 to reciprocate within their respective cylinders 71.

Rear end plate 24 includes peripherally located annular suction chamber 241 and centrally located discharge chamber 251. Valve plate 25 includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as described in U.S. Pat. No. 4,011,029 to Shimizu.

Suction chamber 241 includes inlet portion 241*a* which is connected to an evaporator (not shown) of the external cooling circuit. Discharge chamber 251 is provided with outlet port 251*a* connected to a condenser (not shown) of the cooling circuit. Gaskets 27 and 28 are located between cylinder block 21 and the front surface of valve plate 25 and between the rear surface of valve plate 25 and rear end plate 24, respectively, to seal the mating surfaces of cylinder block 21, valve plate 25 and rear end plate 24. Gaskets 27 and 28 and valve plate 25 thus form valve plate assembly 200. A steel valve retainer 253 is fixed on a central region of the rear surface of valve plate assembly 200 by bolt 254 and nut 255. Valve retainer 253 prevents excessive bend of the reed valve which is provided at discharge port 252 during a compression stroke of pistons 71.

Conduit 18 axially bored through cylinder block 21 links crank chamber 22 to discharge chamber 251 through hole 181 which is axially bored through valve plate assembly 200. A throttling device, such as orifice tube 182, is fixedly disposed within conduit 18. Filter member 183 is disposed in conduit 18 at the rear of orifice tube 182. Accordingly, a portion of the discharge refrigerant gas in discharge chamber 251 always flows into crank chamber 22 with a reduced pressure generated by orifice tube 182. The above mentioned construction and functional manner are described in detail in Japanese Patent Application Publication No. 1-142277.

Figure 2:
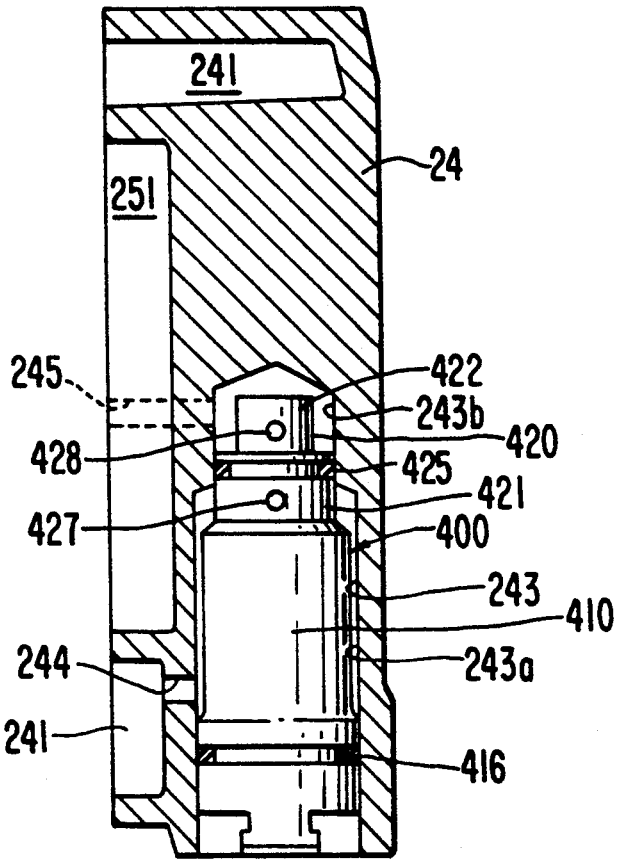
FIG. 2 illustrates a side view of the capacity control mechanism shown in FIG. 1.

With reference to FIG. 2, radially extending cylindrical cavity 243 is formed in rear end plate 24 to accommodate capacity control mechanism 400 which is further discussed below. One end of cylindrical cavity 243 is open to the external environment of the compressor, that is, to atmospheric conditions. Cylindrical cavity 243 includes first portion 243*a* and second portion 243*b* which extends from an inner end of first portion 243*a*. The diameter of second portion 243*b* is smaller than the diameter of first portion 243*a*. First portion 243*a* of cavity 243 is linked to suction chamber 241 through conduit 244 which is formed in rear end plate 24. As illustrated in FIG. 1, conduit 245 is formed in rear end plate 24 to link second portion 243*b* of cavity 243 to hole 256 which is formed in valve plate assembly 200. Hole 256 is linked to central bore 210 through conduit 212 which is formed in the rear portion of cylinder block 21. Central bore 210 is linked to crank chamber 22 through conduit 262 formed in the inner end portion of drive shaft 26, hole 231 of spacer 230 and hole 221 of adjusting screw 220. Accordingly second portion 243*b* of cavity 243 is linked to crank chamber 22 via conduit 245, hole 256, conduit 212, central bore 210, hole 221, hole 231 and conduit 262.

Figure 3:
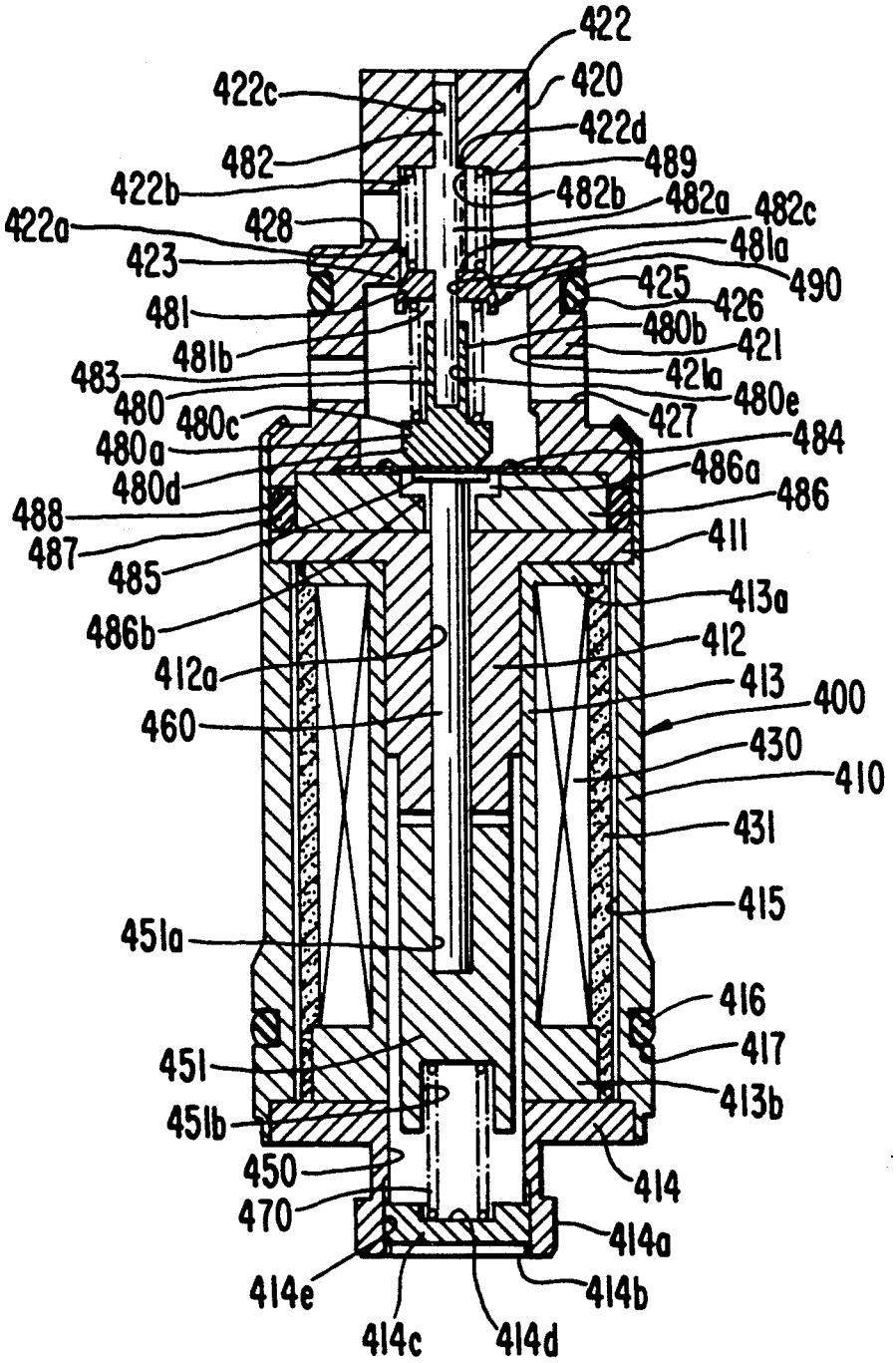
FIG. 3 illustrates a cross-sectional view taken along line 3—3 of FIG. 1.

With reference to FIGS. 2 and 3, capacity control mechanism 400 includes a first annular cylindrical casing 410 of magnetic material located in first portion 243*a* of cavity 243 and a second annular cylindrical casing 420. Casing 420 has a large diameter section 421 and a small diameter section 422 which extends upwardly from a top end of large diameter section 421. First annular cylindrical casing 410 is fixedly disposed within first portion 243*a* of cavity 243 by forcible insertion. Large diameter section 421 of second annual cylindrical casing 420 is fixedly disposed at a top end of first annular cylindrical casing 410. The top end of small diameter section 422 of second annular cylindrical casing 420 terminates at an upper end region of second portion 243*b* of cavity 243.

First annular plate 411 is fixedly disposed at an upper inner region of first annular cylindrical casing 410, and includes an axial annular projection 412 which extends axially and downwardly from an inner peripheral end portion of first annular plate 411. Axial annular projection 412 terminates at a point approximately half the length of first annual cylindrical casing 410. Cylindrical pipe member 413, the length of which is a little less than the length of first annular cylindrical casing 410, is disposed in first annular cylindrical casing 410. Cylindrical pipe member 413 includes first and second annular flanges 413*a* and 413*b* formed at top and bottom ends thereof. An upper half portion of cylindrical pipe member 413 fixedly surrounds axial annular projection 412. Annular disc plate 414 is fixedly disposed at bottom end of first annular cylindrical casing 410 to define an annular cavity 415 formed in cooperation with cylindrical pipe member 413 and first annular cylindrical casing 410. Annular disc plate 414 includes an axial annular projection 414*a* which extends axially and downwardly from an inner peripheral end portion of annular disc plate 414. Annular projection 414*a* includes thread portion 414*b* formed at an inner peripheral surface of a lower half region thereof. Adjusting screw 414*c* is screwed into thread portion 414*b* of annular projection 414*a*. Annular electromagnetic coil 430 is fixedly disposed within annular cavity 415. Insulating material 431, such as epoxy resin, fixedly surrounds annular electromagnetic coil 430.

Vacant space 450 is defined by cylindrical pipe member 413, axial annular projection 414*a* and adjusting screw 414*c*. Cylindrical member 451 of magnetic material is slidably disposed in the axial direction in vacant space 450. First cylindrical rod 460 slidably penetrates through axial annular projection 412. The bottom end portion of rod 460 is fixedly received in cylindrical hole 451*a* formed in the top end surface of cylindrical member 451 through forcible insertion. First coil spring 470 is disposed between adjusting screw 414*c* and cylindrical member 451. A top end of first coil spring 470 is in contract with the top end surface of cylindrical hole 451*b* which is formed at the bottom end surface of cylindrical member 451. A bottom end of first coil spring 470 is in contact with the bottom end surface of cylindrical depression 414*d* which is formed at the top end surface of adjusting screw 414*c*. The restoring force of first coil spring 470 urges cylindrical member 451 upwardly, thereby urging rod 460 upwardly. The restoring force of first coil spring 470 is adjusted by adjusting screw 414*c*.

When electromagnetic coil 430 is energized, an electromagnetic attraction force tending to move cylindrical member 451 upwardly is induced. The magnitude of the electromagnetic attraction force is directly proportional to the amperage of an electric current that is supplied to electromagnetic coil 430 from an electric circuit (not shown). The electric circuit receives a signal representing the heat load on the evaporator, such as the temperature of air immediately before passing through the evaporator, and the signal representing the amount of demand for acceleration of the automobile, such as the magnitude of force on the accelerator. After processing these two signals, an electric current is supplied from the electric circuit to electromagnetic coil 430. The amperage of the electric current is continuously varied within the range from zero amperes to a predetermined maximum amperage, for example, 1.0 ampere.

More precisely, when the heat load on the evaporator is excessively large, such that the temperature of air immediately before passing through the evaporator is excessively high, and when the amount of demand for acceleration of the automobile is small, an electric current having zero amperes, i.e., no electric current is supplied from the electric circuit to the electromagnetic coil 430. However, when the demand for acceleration of the automobile exceeds a predetermined value, the signal representing the demand for acceleration overrides the signal representing the heat load on the evaporator. As a result, an electric current having the predetermined maximum amperage is supplied from the electric circuit to the electromagnetic coil 430 even though the heat load on the evaporator is excessively large. Furthermore, when the heat load on the evaporator is excessively small, such as when the temperature of air immediately before passing through the evaporator is excessively low, an electric current having the predetermined maximum amperage is supplied from the electric circuit to the electromagnetic coil 430 without regard to the demand for acceleration of the automobile.

As further shown in FIG. 3, O-ring seal element 416 is disposed in annular groove 417 formed in the outer peripheral surface of the bottom end portion of first annular cylindrical casing 410. Seal element 416 seals the mating surfaces between the outer peripheral surface of first annular cylindrical casing 410 and the inner peripheral surface of first portion 243*a* of cavity 243. Thus, first portion 243*a* of cavity 243 is sealed off from the ambient atmosphere outside the compressor.

Second cylindrical rod 480 is disposed in cylindrical hollow space 421*a* of large diameter section 421 of second annular cylindrical casing 420. Second cylindrical rod 480 includes large diameter portion 480*a* and smaller diameter portion 480*b*, which upwardly extends from a top end of large diameter portion 480*a* so that annular ridge 480*c* is formed at a position which is a boundary between large and small diameter portionss 480*a* and 480*b*. Large diameter portion 480*a* of second cylindrical rod 480 includes truncated cone region 480*d* formed at a bottom end thereof.

Truncated cone-shaped valve member 481 also is disposed in cylindrical hollow space 421*a* of large diameter section 421 of second annular cylindrical casing 420. Axial hole 481*a* is centrally formed in valve member 481 so as to fitly slidably dispose third cylindrical rod 482 therethrough. A bottom end portion of third cylindrical rod 482 is forcibly inserted into cylindrical hole 480*e* formed at a top end surface of second cylindrical rod 480 so that third cylindrical rod 482 is fixedly connected to second cylindrical rod 480. Second coil spring 483 surrounding second cylindrical rod 480 is resiliently disposed between a side surface of annular ridge 480*c* of second cylindrical rod 480 and a bottom surface of annular depression 481*b* which is formed at a bottom end surface of valve member 481. The restoring force of second coil spring 483 urges valve member 481 upwardly.

Diaphragm 484 is disposed between the bottom end surface of second cylindrical rod 480 and the top end surface of circular disc plate 485 which is disposed on a top end surface of first cylindrical rod 460. An outer peripheral portion of diaphragm 484 is fixedly disposed between the bottom end surface of the large diameter section 421 of second annular cylindrical casing 420 and the top end surface of second annular plate 486 which is sandwiched by first annular plate 411 and the bottom end of large diameter section 421 of second annular cylindrical casing 420. The top end portion of first cylindrical rod 460 slidably penetrates through second annular plate 486. Indent 486*a* is formed at the top end surface of second annular plate 486 so that annular ridge 486*b* is formed at an inner peripheral surface of second annular plate 486. Annular ridge 486*b* receives circular disc plate 485 disposed on the top end surface of first cylindrical rod 460.

O-ring seal element 487 is elastically disposed within annular cylindrical hollow space 488, which is defined by first and second annular plates 411 and 486, large diameter section 421 of second annular cylindrical casing 420 and first annular cylindrical casing 410. Seal element 487 seals first portion 243*a* of cavity 243 and cylindrical hollow space 421*a* of large diameter section 421 of second annular cylindrical casing 420 from ambient atmosphere.

Small diameter section 422 of second annular cylindrical casing 420 includes cylindrical hollow space 422*a* having first region 422*b* and second region 422*c* which extends from a central portion of a top end of first region 422*b*. The diameter of first region 422*b* is greater than the diameter of second region 422*c* so that annular ridge 422*d* is formed at a position which is a boundary between first and second regions 422*b* and 422*c*.

First region 422*b* of cylindrical hollow space 422*a* is linked to the top end of cylindrical hollow space 421*a* at its bottom end. The diameter of cylindrical hollow space 421*a* is greater than the diameter of first region 422*b* of cylindrical hollow space 422*a* so that annular ridge 423 is formed at a position which is a boundary between cylindrical hollow space 421*a* and first region 422*b* of cylindrical hollow space 422*a*. Annular ridge 423 functions as a valve seat which receives valve member 481. An upper end portion of third cylindrical rod 482 is slidably disposed in the axial direction within second region 422*c* of cylindrical hollow space 422*a*. Third cylindrical rod 482 includes large diameter portion 482*a* formed at a middle region thereof, thereby forming upper and lower annular ridges 482*b* and 482*c* at the both axial ends of large diameter portion 482*a*. A side wall of upper annular ridge 482*b* faces the side wall of annular ridge 422*d*, and a side wall of lower annular ridge 482*c* faces a top end surface of valve member 481. Third coil spring 489 surrounding large diameter portion 482*a* of third cylindrical rod 482 is resiliently disposed between the top end surface of valve member 481 and the side wall of annular ridge 422*d*. The restoring force of third coil spring 489 urges valve member 481 downwardly.

O-ring seal element 425 is disposed in an annular groove 426 formed at the outer peripheral surface of large diameter section 421 of second annular cylindrical casing 420 to seal the mating surfaces between the outer peripheral surface of large diameter section 421 of second annular cylindrical casing 420 and the inner peripheral surface of second portion 243*b* of cavity 243. Thus, second portion 243*b* of cavity 243 is sealed off from first portion 243*a* of cavity 243.

A plurality of radial holes 427 are formed at a side wall of large diameter section 421 of second annular cylindrical casing 420 to link first portion 243*a* of cavity 243 to cylindrical hollow space 421*a* of large diameter section 421 of second annular cylindrical casing 420. Therefore, fluid communication between suction chamber 241 and cylindrical hollow space 421*a* of large diameter section 421 of second annular cylindrical casing 420 is obtained through conduit 244, first portion 243*a* of cavity 243 and radial holes 427.

A plurality of second radial holes 428 are formed at a side wall of a lower end portion of small diameter section 422 of second annular cylindrical casing 420 to link second portion 243*b* of cavity 243 to first region 422*b* of cylindrical hollow space 422*a* of small diameter section 422 of second annular cylindrical casing 420. Therefore, fluid communication between crank chamber 22 and first region 422b of cylindrical hollow space 422a of small diameter section 422 of second annular cylindrical casing 420 is obtained through conduit 262, hole 231, hole 221, central bore 210, conduit 212, hole 256, conduit 245, second portion 243b of cavity 243 and radial holes 428.

In the above mentioned construction of capacity control mechanism 400, second and third coil springs 483 and 489 are selected to bias the top end surface of valve member 481 against the side wall of lower annular ridge 482c of third cylindrical rod 482. As long as the top end surface of valve member 481 is in contact with the side wall of lower annular ridge 482c of third cylindrical rod 482, second cylindrical rod 480, valve member 481, second coil spring 483 and third cylindrical rod 482 are regarded as substantially one body. Therefore, the top end surface of the central region of diaphragm 484 is maintained in contact with the bottom end surface of second cylindrical rod 480 by virtue of the restoring force of third coil spring 489. Similarly, the bottom end surface of the central region of diaphragm 484 is maintained in contact with the top end surface of circular plate 485 by virtue of the restoring force of first coil spring 470. The location of upper annular ridge 482b of third cylindrical rod 482 is designed to be in contact with the side surface of annular ridge 422d when valve member 481 is received on annular ridge 423 while the top end surface of valve member 481 is in contact with the side surface of lower annular ridge 482c.

Indent 486a, which is formed at the top end surface of second annular plate 486, faces the bottom end surface of diaphragm 484. Indent 486a is linked to the ambient atmosphere outside of the compressor via gap 412a created between rod 460 and annular projection 412, vacant space 450, and the gap 414e created between axial annular projection 414a and adjusting screw 414c. Thus, the bottom end surface of diaphragm 484 is in contact with and thereby receives air at atmospheric pressure.

Similarly, cylindrical hollow space 421a of large diameter section 421 of second annular cylindrical casing 420 is linked to suction chamber 241 via radial holes 427, first portion 243a of cavity 243, and conduit 244. Thus, the top end surface of diaphragm 484 is in contact with and thereby receives the refrigerant gas at the suction chamber pressure.

During operation of compressor 10, drive shaft 26 is rotated by the engine of the automobile through electromagnetic clutch 300. Cam rotor 40 is rotated with drive shaft 26, thereby rotating slant plate 50 as well, which in turn causes wobble plate 60 to nutate. The nutation motion of wobble plate 60 then reciprocates pistons 71 out of phase in their respective cylinders 70. As pistons 70 are reciprocated, refrigerant gas is introduced into suction chamber 241 through inlet port 241a, flows into each cylinder 70 through suction ports 242, and then is compressed. The compressed refrigerant gas then is discharged to discharge chamber 251 from each cylinder 70 through discharge ports 252, and continues into the cooling circuit through outlet port 251a.

The capacity of compressor 10 is adjusted in order to maintain a constant pressure in suction chamber 241, irrespective of the changes in the heat load on the evaporator or the rotational speed of the compressor. The capacity of the compressor is adjusted by changing the angle of the slant plate, which is dependent upon the crank chamber pressure, or more precisely, which is dependent upon the differential between the crank chamber and the suction chamber pressures. During operation of compressor 10, the pressure of the crank chamber increases due to blow-by gas flowing past pistons 71 as they reciprocate in cylinders 70. As the crank chamber pressure increases relative to the suction chamber pressure, the slant angle of slant plate 50 as well as the slant angle of wobble plate 60 decreases, thereby decreasing the capacity of the compressor. Likewise, a decrease in the crank chamber pressure relative to the suction chamber pressure causes an increase in the capacity of the compressor.

The operation of capacity control mechanism 400 of compressor 10 in accordance with one embodiment of the present invention is carried out in the following manner. With reference to FIGS. 1–4, when the heat load on the evaporator is excessively large and concurrently therewith the amount of demand for acceleration of the automobile is small, no electric current is supplied from the electric circuit to the electromagnetic coil 430 and thereby no electromagnetic attraction force is induced. As a result, diaphragm 484 is urged upwardly only by virtue of the restoring force of first coil spring 470 and the atmospheric pressure force acting on the bottom end surface of diaphragm 484. Under such conditions, valve member 481 is situated so as to maintain an opening for communication between second portion 243b of cavity 243 linked to the crank chamber 22 and first portion 243a of cavity 243 linked to the suction chamber 241. Valve member 481 maintains such a position until the suction chamber pressure drops to a first predetermined value, for example, 1.0 $kg/cm^2G$, at which time the upward and downward forces acting on diaphragm 484 will be balanced. Thus, slant plate 50 and wobble plate 60 are disposed at a maximum slant angle with respect to the plane perpendicular to the longitudinal axis of drive shaft 26 due to an opening for fluid communication between crank chamber 22 and suction chamber 241; and accordingly, compressor 10 operates in a maximum capacity displacement until the suction chamber pressure drops to the first predetermined value. Once the suction chamber pressure drops to the first predetermined value, the slant angle of the slant plate 50 and wobble plate 60 is substantially adjusted by only the axial bend of diaphragm 484 responsive to the suction chamber pressure in order to thereby maintain the suction chamber pressure at the first predetermined value.

On the other hand, when the heat load on the evaporator is excessively small, an electric current having a predetermined maximum amperage is supplied from the electric circuit to the electromagnetic coil 430 without regard to the amount of demand for acceleration of the automobile. As a result, diaphragm 484 is urged upwardly by virtue of the restoring force of first coil spring 470, a predetermined maximum electromagnetic attraction force induced by electromagnetic coil 430, and the atmospheric pressure force acting on the bottom end surface of diaphragm 484. Valve member 481 thus moves upwardly so as to close the fluid communication opening between second portion 243b of cavity 243 and first portion 243a of cavity 243. Valve member 481 thus moves upwardly so as to close the fluid communication opening between second portion 243b of cavity 243 and first portion 243a of cavity 243. Valve member 481 maintains such a position until the suction chamber pressure rises to a second predetermined value, for example, 4.0 $kg/cm^2G$, at which time the upward and downward forces acting on diaphragm 484 are balanced. Therefore, slant plate 50 and wobble plate 60 are disposed at a minimum slant angle with respect to the plane perpendicular to the longitudinal axis of drive shaft 26 due to the block in fluid communication between crank chamber 22 and suction chamber 241; and accordingly, compressor 10 operates at a minimum capacity displacement until the suction chamber pressure rises to the second predetermined value. Once the suction chamber pressure rises to the second predetermined value, the slant angle of slant plate 50 and wobble plate 60 is substantially adjusted by only the axial bend of diaphragm 484 responsive to the suction chamber pressure in order to thereby maintain the suction chamber pressure at the second predetermined value.

Figure 4:
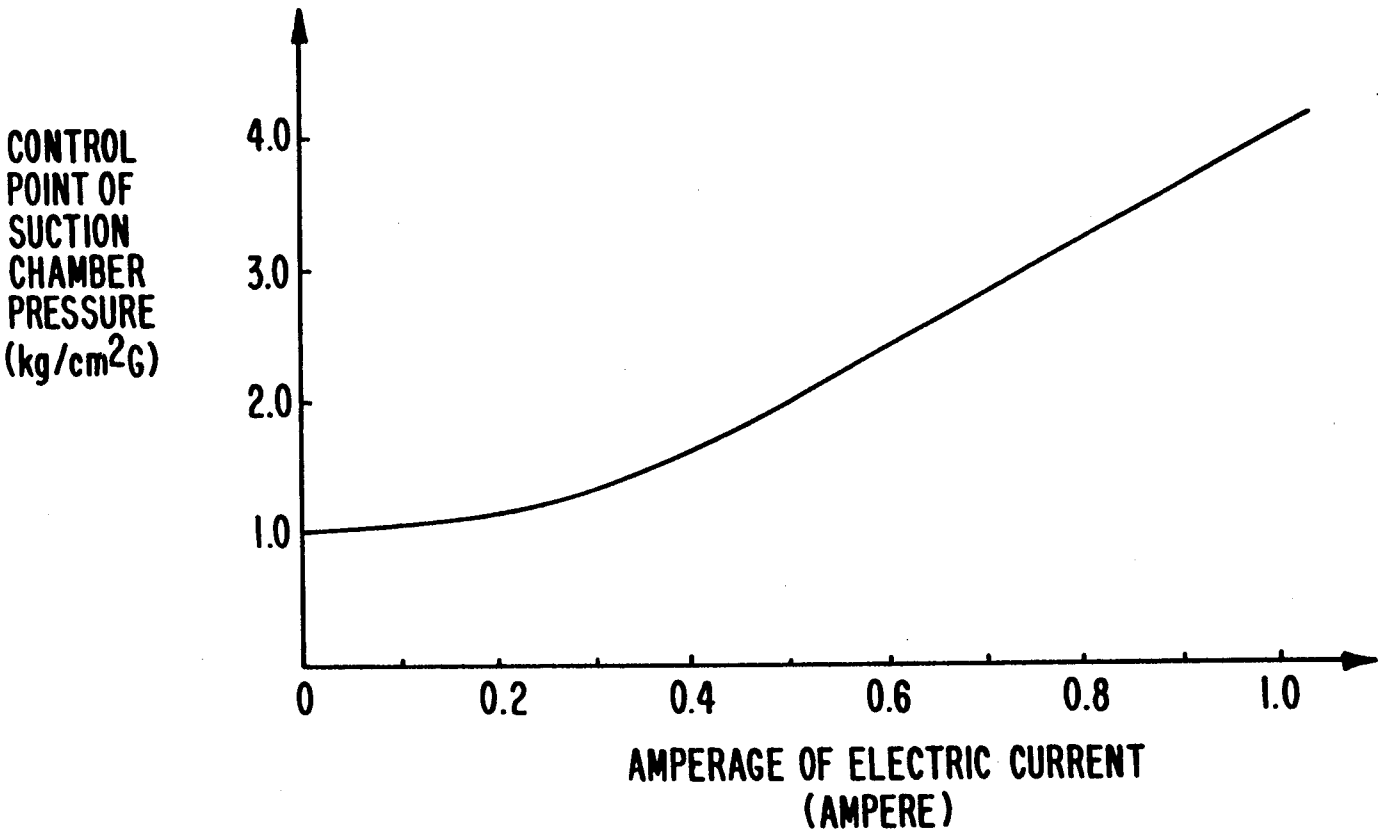
FIG. 4 is a graph illustrating the relationship between a control point of suction chamber pressure and amperage of an external electric current supplied to an electromagnetic coil of the capacity control mechanism according to one embodiment of this invention.

Furthermore, since the amperage of the electric current supplied from the electric circuit to the electromagnetic coil 430 is continuously varied within the range from zero to the predetermined maximum value in response to changes in the amperage of the aforementioned two signals, the electromagnetic attraction force which urges valve member 481 upwardly is likewise continuously varied in response to these amperage changes. Therefore, as shown in FIG. 4, a control point of the suction chamber pressure at which the upward and downward forces acting on diaphragm 484 are balanced is also continuously varied within the range defined by the first and second predetermined values.

Furthermore, when the demand for acceleration of the automobile exceeds the predetermined value at a time when the suction chamber pressure is being maintained at the first predetermined value, i.e., 1.0 $kg/cm^2G$, the angular position of slant plate 50 and wobble plate 60 is forcibly changed to, and then is maintained at, the minimum slant angle until the suction chamber pressure rises to the second predetermined value, i.e., 4.0 $kg/cm^2G$. This maximally reduces the energy consumption by the compressor, the driving force which is derived from the automobile engine, and thereby assists in providing the demanded acceleration.

In other words, in a situation where electromagnetic coil 430 is first receiving an electric current at or near zero amperes, and a sudden change occurs to increase the electric current to the predetermined maximum amperage, i.e., 1.0 amperes, the location of valve element 481 is forcibly moved and then maintained so as to close the fluid communication opening between second portion **243*b* of cavity 243 and first portion 243*a* of cavity 243**. The communication opening remains closed until such time that the suction chamber pressure rises to the second predetermined value, i.e., 4.0 $kg/cm^2G$.

Figure 5:
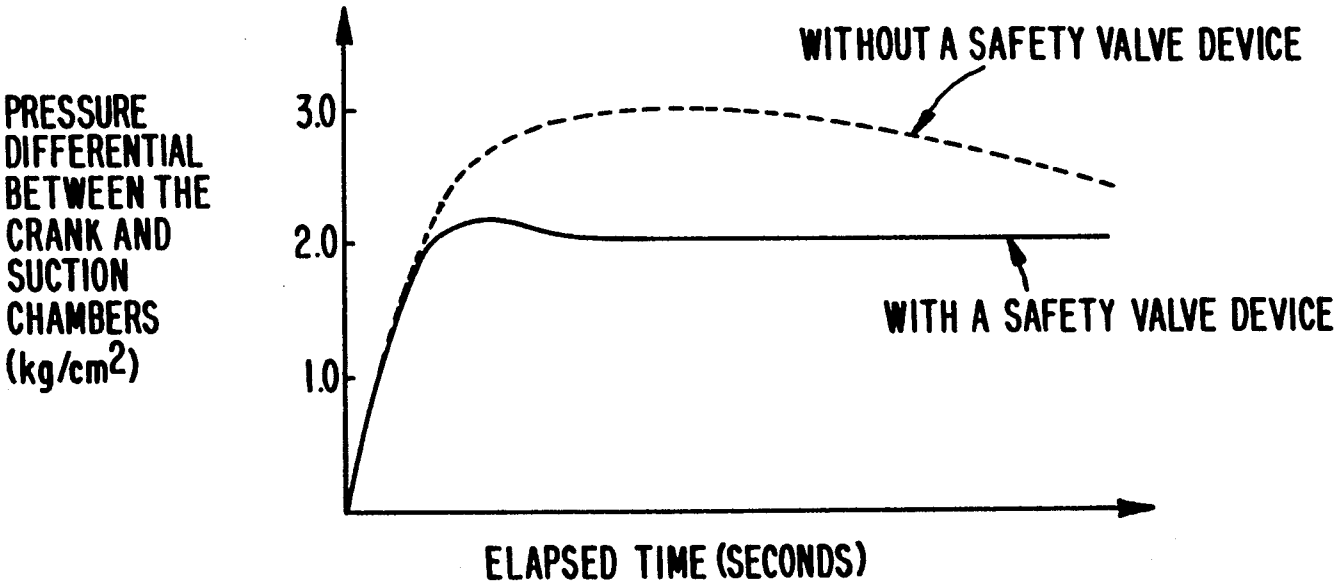
FIG. 5 is a graph showing changes in pressure differential between the crank and suction chambers over a period of time upon supplying an electric current having a predetermined maximum amperage to an electromagnetic coil of the capacity control mechanism.

If the block in fluid communication between crank chamber 22 and suction chamber 241 is maintained for a long time period, and if a safety valve device such as discussed in the description of the prior art is not provided in the compressor, an abnormal rise in the crank chamber pressure may occur due to the conduction of the refrigerant gas from discharge chamber 251 to crank chamber 22 through conduit 18 (including orifice tube 182) and blow-by gas leaking past pistons 71 in cylinder chambers 70 as the pistons 71 reciprocate. Thus, as the pressure differential between crank chamber 22 and the suction chamber 241 becomes excessively large, as shown by the dashed line in FIG. 5, a force is generated which excessively urges wobble plate 60 rearwardly. This excessive urging force on wobble plate 60 causes excessive rearward movement of wobble plate 60, and thereby results in excessive friction between the rear end surface of annular projection 65 of wobble plate 60 and the front end surface of balance weight ring 80, and between the inner end surface of drive shaft 26 and a front end surface of spacer 230 disposed in central bore 210. This excessive friction may in turn then causes a seizure between annular projection 65 of wobble plate 60 and balance weight ring 80 or between drive shaft 26 and spacer 230.

In order to resolve the above defect, capacity control mechanism 400 is provided with safety valve device 490 therein. Safety valve device 490 includes valve member 481, second coil spring 483 having a restoring force which urges valve member 481 upwardly, and third coil spring 489 having a restoring force which urges valve member 481 downwardly. Safety valve device 490 functions in the following manner. Valve member 481 is urged downwardly by the restoring force of third coil spring 489 and the crank chamber pressure received on the effective pressure receiving area of an upper end surface thereof; at the same time, valve member 481 is urged upwardly by the restoring force of second coil spring 483 and the suction chamber pressure received on the effective pressure receiving area of a lower end surface thereof. Second coil spring 483 biases valve member 481 upwardly to a first position along third cylindrical rod 482 so long as valve member 481 is away from annular ridge 423. An excessive downward movement of valve member 481 is prevented by contact between the bottom surface of annular depression **481*b* of valve member 481 and the top end surface of second cylindrical rod 480. Safety valve device 490 is designed so that valve member 481 is moved away from annular ridge 423 by sliding along third cylindrical rod 482 to a second position away from annular ridge 423 when the pressure differential between crank chamber 22 and suction chamber 241 rises to a predetermined value, for example, 2.0 $kg/cm^2$. Therefore, the crank chamber pressure is forcibly and quickly reduced to maintain the pressure differential between crank chamber 22 and suction chamber 241 at the predetermined value, i.e., 2.0 $kg/cm^2$, as shown by the solid line in FIG. 5, and thereby maintain the annular position of slant plate 50 and wobble plate 60 at the minimum slant angle even when the amperage of the electric current is suddenly increased from zero amperes to the predetermined maximum amperage. Thus, the occurrence of an excessive force urging wobble plate 60 rearwardly can be prevented, which in turn prevents the occurrence of excessive friction between the rear end surface of angular projection 65 of wobble plate 60 and the front end surface of balance weight ring 80, and between the inner end surface of drive shaft 26 and the front end surface of spacer 230 disposed in central bore 210. Furthermore, safety valve device 490 functions equally as well in the event the fluid communication opening between crank chamber 22 and suction chamber 241 is blocked for a long time period due to problems with the movement of diaphragm 484**.

As discussed above, since capacity control mechanism 400 is provided with safety valve device 490 therein, the complicated process of forming an additional passageway for communicating between crank chamber 22 and suction chamber 241 in cylinder block 21, and the process of disposing the safety valve in the additional passageway, are eliminated. Therefore, according to the present invention, a compressor having a variable displacement control mechanism and safety valve device for preventing an abnormal pressure differential between the crank and suction chambers can be easily manufactured.

Furthermore, since third cylindrical rod 482 is fitly slidably disposed through axial hole 481*a* of valve member 481, valve member 481 can be smoothly guided by third cylindrical rod 482 during axial movement thereof and any tendency for valve member 481 to incline or twist can be effectively prevented. Therefore, unexpected partial air gaps between valve member 481 and annular ridge 423 can be avoided when valve member 481 is received on annular ridge 423. This effectively prevents abnormal friction between portions of valve member 481 and annular ridge 423, and prevents defective operation of valve member 481. Accordingly, durability and operational reliability of capacity control mechanism 400 are improved.

This invention has been described in connection with the preferred embodiment. This embodiment, however, is merely exemplary only and the invention is not restricted thereto. It will be easily understood by those skilled in the art the variations can be easily made within the scope of this invention as defined by the claims.

I claim:

1. A slant plate type refrigerant compressor comprising:

a compressor housing enclosing a crank chamber, a suction chamber and a discharge chamber therein, said compressor housing comprising a cylinder block having a plurality of cylinders formed therethrough;

a piston slidably fitted within each of said cylinders;

drive means coupled to said pistons for reciprocating said pistons within said cylinders, said drive means including a drive shaft rotatably supported in said housing and coupling means for drivingly coupling said drive shaft to said pistons such that rotary motion of said drive shaft is converted into reciprocating motion of said pistons, said coupling means including a slant plate having a surface disposed at an adjustable inclined angle relative to a plane perpendicular to said drive shaft, the inclined angle of said slant plate being adjustable in response to changes in fluid pressure in said crank chamber relative to fluid pressure in said suction chamber to vary the stroke length of said pistons in said cylinders to thereby vary the capacity of said compressor;

a passageway formed in said housing for linking said crank chamber and said suction chamber in fluid communication, said passageway including a valve seat; and capacity control means for varying the capacity of the compressor by adjusting the inclined angle of said slant plate, said capacity control means including valve control means disposed in said passageway for controlling the opening and closing of said passageway in response to changes in fluid pressure in said suction chamber to thereby control the capacity of the compressor, said valve control means including pressure sensing means for sensing fluid pressure in said suction chamber and a valve element connected to said pressure sensing means, said valve element being received on and moving away from said valve seat in response to changes in fluid pressure in said suction chamber so as to open and close said passageway to thereby control the capacity of the compressor, said valve element including a valve member, a rod member fitly and slidably disposed through said valve member and biasing means for biasing said valve member to a first position along said rod member when said valve member is away from said valve seat, said valve member being forcibly disengaged from the first position along said rod member to slide along said rod member to a second position away from said valve seat to open said passageway when the fluid pressure differential between said crank chamber and said suction chamber exceeds a predetermined value.

2. The compressor of claim 1 wherein said capacity control means further includes an externally controlled solenoid actuator which is capable of moving said valve element to vary the magnitude of the suction chamber pressure which controls the opening and closing of said passageway, said externally controlled solenoid actuator being responsive to changes in at least one external signal.

3. The compressor of claim 2 wherein the at least one external signal is dependent on heat load of a cooling circuit in which said compressor is capable of being installed.

4. The compressor of claim 3 wherein the at least one external signal is dependent on acceleration demand in a vehicle which is capable of driving said compressor.

5. The compressor of claim 1 wherein said biasing means comprises at least one coil spring.

6. The compressor of claim 1 wherein an annular ridge is formed on said rod member to engage said valve member when said valve member is away from said valve seat.

7. A slant plate type refrigerant compressor comprising:

a compressor housing enclosing a crank chamber, a suction chamber and a discharge chamber therein, said compressor housing comprising a cylinder block having a plurality of cylinders formed therethrough;

a piston slidably fitted within each of said cylinders;

drive means coupled to said pistons for reciprocating said pistons within said cylinders, said drive means including a drive shaft rotatably supported in said housing and coupling means for drivingly coupling said drive shaft to said pistons such that rotary motion of said drive shaft is converted into reciprocating motion of said pistons, said coupling means including a slant plate having a surface disposed at an adjustable inclined angle relative to a plane perpendicular to said drive shaft, the inclined angle of said slant plate being adjustable in response to changes in fluid pressure in said crank chamber relative to fluid pressure in said suction chamber to vary the stroke length of said pistons in said cylinders to thereby vary the capacity of said compressor;

a passageway formed in said housing for linking said crank chamber and said suction chamber in fluid communications, said passageway including a valve seat;

capacity control means for varying the capacity of the compressor by adjusting the inclined angle of said slant plate, said capacity control means including valve control means disposed in said passageway for controlling the opening and closing of said passageway in response to changes in fluid pressure in said suction chamber to thereby control the capacity of the compressor, said valve control means including pressure sensing means for sensing fluid pressure in said suction chamber and a valve element connected to said pressure sensing means, said valve element being received on and moving away from said valve seat in response to changes in fluid pressure in said suction chamber so as to open and close said passageway to thereby control the capacity of the compressor; and safety valve means coupled to said valve control means for limiting axial movement of said valve element away from said valve seat during the opening of said passageway, said safety valve control means further preventing twisting of said valve element with respect to said valve seat during closing of said passageway.

8. The compressor of claim 7 wherein said capacity control means further includes an externally controlled solenoid actuator which is capable of moving said valve element to vary the magnitude of the suction chamber pressure which controls the opening and closing of said passageway, said externally controlled solenoid actuator being responsive to changes in at least one external signal.

9. The compressor of claim 7 wherein the at least one external signal is dependent on heat load of a cooling circuit in which said compressor is capable of being installed and the acceleration demand in a vehicle which is capable of driving said compressor.

10. A slant plate type refrigerant compressor comprising:

a compressor housing enclosing a crank chamber, a suction chamber and a discharge chamber therein, said compressor housing comprising a cylinder block having a plurality of cylinders formed therethrough;

a piston slidably fitted within each of said cylinders;

drive means coupled to said pistons for reciprocating said pistons within said cylinders, said drive means including a drive shaft rotatably supported in said housing and coupling means for drivingly coupling said drive shaft to said pistons such that rotary motion of said drive shaft is converted into reciprocating motion of said pistons, said coupling means including a slant plate having a surface disposed at an adjustable inclined angle relative to a plane perpendicular to said drive shaft, the inclined angle of said slant plate being adjustable in response to changes in fluid pressure in said crank chamber relative to fluid pressure in said suction chamber to vary the stroke length of said pistons in said cylinders to thereby vary the capacity of said compressor;

a passageway formed in said housing for linking said crank chamber and said suction chamber in fluid communication, said passageway including a valve seat;

capacity control means for varying the capacity of the compressor by adjusting the inclined angle of said slant plate, said capacity control means including valve control means disposed in said passageway for controlling the opening and closing of said passageway in response to changes in fluid pressure in said suction chamber to thereby control the capacity of the compressor, said valve control means including pressure sensing means for sensing fluid pressure in said suction chamber and a valve element connected to said pressure sensing means, said valve element being received on and moving away from said valve seat in response to changes in fluid pressure in said suction chamber so as to open and close said passageway to thereby control the capacity of the compressor; and safety valve means within said valve control means for preventing an abnormal fluid pressure differential between said crank and suction chambers, said safety valve means controlling movement of said valve element relative to said valve seat to open said passageway upon the occurrence of a predetermined abnormal fluid pressure differential between said crank and suction chambers.

11. The compressor of claim 10 wherein said safety valve means comprises a valve member, a rod member fitly and slidably disposed through said valve member and biasing means for biasing said valve member to a first position along said rod member as long as said valve member is away from said valve seat, said valve member being forcibly disengaged from first position along said rod member to slide along said rod member to a second position away from said valve seat to open said passageway when the fluid pressure differential between said crank chamber and said suction chamber exceeds a predetermined value.

12. The compressor of claim 10 wherein said safety valve means comprises an externally controlled solenoid actuator which is capable of moving said valve element to vary the magnitude of the suction chamber pressure which controls the opening and closing of said passageway, said externally controlled solenoid actuator being responsive to changes in at least one external signal.

13. The compressor of claim 11 wherein the at least one external signal is dependent on heat load of a cooling circuit in which said compressor is capable of being installed and the acceleration demand in a vehicle which is capable of driving said compressor.

* * * * *